US008474294B2

(12) United States Patent
Kopp et al.

(10) Patent No.: US 8,474,294 B2
(45) Date of Patent: Jul. 2, 2013

(54) ROLLING STAND, ROLLING TRAIN, AND METHOD FOR ROLLING METAL STRIP

(75) Inventors: Reiner Kopp, Aachen (DE); Hans-Peter Richter, Friedewald (DE); Heinrich Röse, Hilchenbach (DE)

(73) Assignee: SMS Siemag Aktiengesellschaft, Düsseldorf (DE)

( * ) Notice: Subject to any disclaimer, the term of this patent is extended or adjusted under 35 U.S.C. 154(b) by 708 days.

(21) Appl. No.: 11/921,584

(22) PCT Filed: May 2, 2007

(86) PCT No.: PCT/EP2007/003832

§ 371 (c)(1),
(2), (4) Date: Mar. 11, 2008

(87) PCT Pub. No.: WO2007/137669

PCT Pub. Date: Dec. 6, 2007

(65) Prior Publication Data

US 2009/0100890 A1 Apr. 23, 2009

(30) Foreign Application Priority Data

May 27, 2006 (DE) ..... 10 2006 024 775

(51) Int. Cl.
*B21B 39/20* (2006.01)

(52) U.S. Cl.
USPC ..... 72/252.5; 72/197; 72/234; 72/119

(58) Field of Classification Search
USPC ..... 72/10.7, 191, 195, 197, 199, 237, 72/240, 241.2, 242.2, 243.2, 243.4, 252.5, 72/187, 234, 119, 198, 243.6, 248, 365.2, 72/366.2; 492/1, 38, 39
See application file for complete search history.

(56) References Cited

U.S. PATENT DOCUMENTS

| | | | | |
|---|---|---|---|---|
| 3,613,420 | A * | 10/1971 | Perrenoud | 72/131 |
| 3,630,059 | A * | 12/1971 | Henkel | 72/177 |
| 6,209,375 | B1 * | 4/2001 | Kurose | 72/181 |
| 6,286,354 | B1 * | 9/2001 | Kajiwara et al. | 72/237 |
| 6,739,167 | B2 * | 5/2004 | Kobayashi et al. | 72/197 |
| 6,796,156 | B2 * | 9/2004 | Natalis et al. | 72/75 |
| 6,877,206 | B2 * | 4/2005 | Hall et al. | 29/527.7 |
| 2004/0112104 | A1 * | 6/2004 | Scamans et al. | 72/187 |

FOREIGN PATENT DOCUMENTS

| | | |
|---|---|---|
| DE | 198 31 882 | 1/2000 |
| DE | 101 13 610 | 10/2002 |

* cited by examiner

*Primary Examiner* — Dana Ross
*Assistant Examiner* — Matthew G Katcoff
(74) *Attorney, Agent, or Firm* — Lucas & Mercanti, LLP; Klaus P. Stoffel

(57) ABSTRACT

The invention concerns a rolling stand, a rolling train, and a method for rolling a stepped preprofiled metal strip. In order to guarantee that the metal strip is free of waviness in its longitudinal direction, even after individual thickness reduction of the steps, the invention proposes that the thickness reduction be carried out on a step-specific basis according to the following mathematical relationship: $\Delta h_i/h_i=\Delta h_{i+1}/h_{i+1}=\epsilon$=constant, where $\Delta h_i$ represents the amount of the thickness reduction in the region of the i-th step, and $h_i$ represents the value of the resulting thickness of the metal strip 200 after rolling in the region of the i-th step.

8 Claims, 2 Drawing Sheets

ROLLING STAND, ROLLING TRAIN, AND METHOD FOR ROLLING METAL STRIP

The invention concerns a rolling stand for the stepped rolling of metal strip, especially metal strip composed of steel, aluminum, copper, or a copper alloy. The invention also concerns a rolling train with at least one rolling stand of this type and a corresponding method.

Rolling stands and methods for producing stepped thickness profiles over the width of a strip-shaped metal strip are basically well known from the prior art, e.g., from German Early Disclosure DE 198 31 882 A1 or German Patent DE 101 13 610 C2. To produce the desired thickness profile, e.g., a stepped profile, the two cited documents recommend that the metal strip, which typically has an initially rectangular cross section, be rolled lengthwise with several pressing rolls that are staggered in the direction of rolling. In this process, the pressing rolls, which are arranged staggered in the direction of conveyance or side by side, each press into the metal strip, which is supported by a support device, and in this way deform the strip as desired in the width direction.

The pressing rolls proposed for use in the cited documents allow only locally very limited working of the metal strip in a narrow range in the width direction. Therefore, as has already been noted, a large number of these pressing rolls in a staggered arrangement is necessary, e.g., for rolling relatively wide steps into the metal strip. Due to the large number of pressing rolls that is necessary and their staggered arrangement, the design of previously known rolling stands of this type for realizing stepped profiles in metal strip is quite complicated.

Proceeding from this prior art, the objective of the invention is to reduce a stepped preprofiled metal strip in the height of its steps by rolling without the development of waviness of the metal strip in its longitudinal direction.

This objective is achieved by the object of claim 1. This object is characterized by the fact that the two or more partial rolls are each cylindrically shaped and together with the support device fix respective adjacent partial roll gaps with different height values $h_i$, $h_{i+1}$, where $h_i \neq h_{i+1}$ and i=1, 2, . . ., 1, where the adjacent partial roll gaps together define the overall roll gap cross section, which has a stepped shape, and that the height values of respective adjacent partial roll gaps are individually selected in such a way that they satisfy the following mathematical relationship:

$$\Delta h_i/h_i=\Delta h_{i+1}/h_{i+1}=\epsilon=\text{constant}$$

with respect to the metal strip entering the overall roll gap, which metal strip has been provided with stepped preprofiling that is geometrically similar to the overall roll gap cross section before rolling but which has greater respective step heights of $h_{i+\Delta hi}$ and $h_{i+1}+\Delta h_{i+1}$, where $h_i+\Delta h_i \neq h_{i+1}+\Delta h_{i+1}$ and $\Delta h_i>0$ and $\Delta h_{i+1}>0$, than the partial roll gaps (i).

With a thickness reduction of the stepped preprofiled metal strip according to the claimed mathematical relationship, the material rolled out from the height of the metal strip or the flow of material that results from this is uniformly distributed in the longitudinal direction of the metal strip, specifically, with the advantage that waviness does not develop.

The rolling stand required for this in accordance with the invention has a simple, space-saving design, because it has only partial rolls that are arranged side by side transversely to the running direction of the metal strip and not a large number of partial rolls arranged in a staggered way in the running direction.

The concept that the partial rolls are arranged side by side "at the same level" means that the partial rolls arranged side by side are arranged on one side of the metal strip and not staggered in the direction of conveyance of the metal strip.

The claimed stepped preprofiling of the metal strip in approximation to the stepped overall roll gap cross section of the rolling stand of the invention is absolutely necessary, because otherwise no differently sized height steps transverse to the direction of conveyance could be distinguished in the entering metal strip, and the metal strip would then have only uniform thickness with $h_i=h_{i+1}$=constant transverse to its direction of conveyance. According to the claimed mathematical relationship, $\Delta h_i=\Delta h_{i+1}$ would then have to apply; this would then be the case of a uniform thickness reduction over the entire width of the metal strip, which, however, is not the object of the invention. In contrast, the invention concerns only the thickness reduction of preprofiled stepped sections, and the advantageous effect that the resulting metal strip shows no waviness is obtained only when the thickness reductions for the individual steps transverse to the direction of conveyance of the metal strip are individually computed and carried out according to the claimed mathematical relationship.

In accordance with a first embodiment, it is advantageous if the height values of the partial roll gaps are automatically adjusted by means of an adjusting device with knowledge of the step heights of the entering stepped preprofiled metal strip. When there is a change in the step heights of the entering metal strip, an adjustment of the height values of the partial roll gaps can then be made very quickly by the adjusting device.

Advantageous modifications of the rolling stand are specified in the dependent claims.

It is advantageous for the rolling stand to be designed for hot rolling or cold rolling of the metal strip.

The aforementioned objective of the invention is further achieved by a rolling train, especially a tandem rolling mill. This rolling train then comprises a first rolling stand with shape rolls or grooved rolls for stepped preprofiling of the metal strip. The first rolling stand or roughing stand is then followed in the running direction of the metal strip by at least a second rolling stand, which is designed in accordance with the invention. A thickness reduction of the stepped metal strip is then carried out in the one or more downstream rolling stands, with the heights of the individual adjacent steps being individually reduced according to the claimed mathematical relationship. The second rolling stand can be followed downstream by additional rolling stands in accordance with the invention. Each of the upstream rolling stands in accordance with the invention then carries out the required task of providing stepped preprofiling of the metal strip for the next downstream rolling stand of the invention. A plurality of rolling stands of the invention arranged one after the other is necessary especially if a very large reduction of the thickness of the metal strip is to be carried out. Alternatively, a large thickness reduction can also be realized by a single reversing stand designed in accordance with the invention.

The aforementioned objective of the invention is further achieved by a method for rolling a rolled strip. The advantages of both the claimed rolling train and the claimed method are the same as the advantages described above with reference to the rolling stand.

Six figures accompany the invention.

Figure 3A:
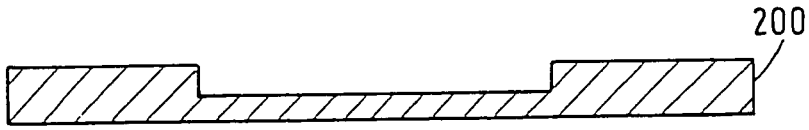

FIG. 3*a* shows a cross section of the metal strip after the strip has left the rolling stand of the invention in accordance with the first embodiment.

Figure 3B:
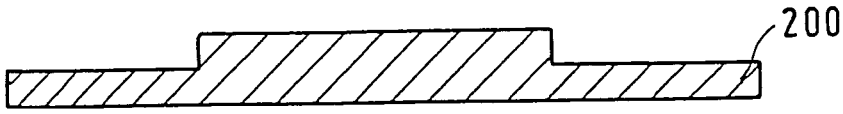

FIG. 3*b* shows an alternative cross section of the metal strip after the strip has left the rolling stand.

Figure 4:
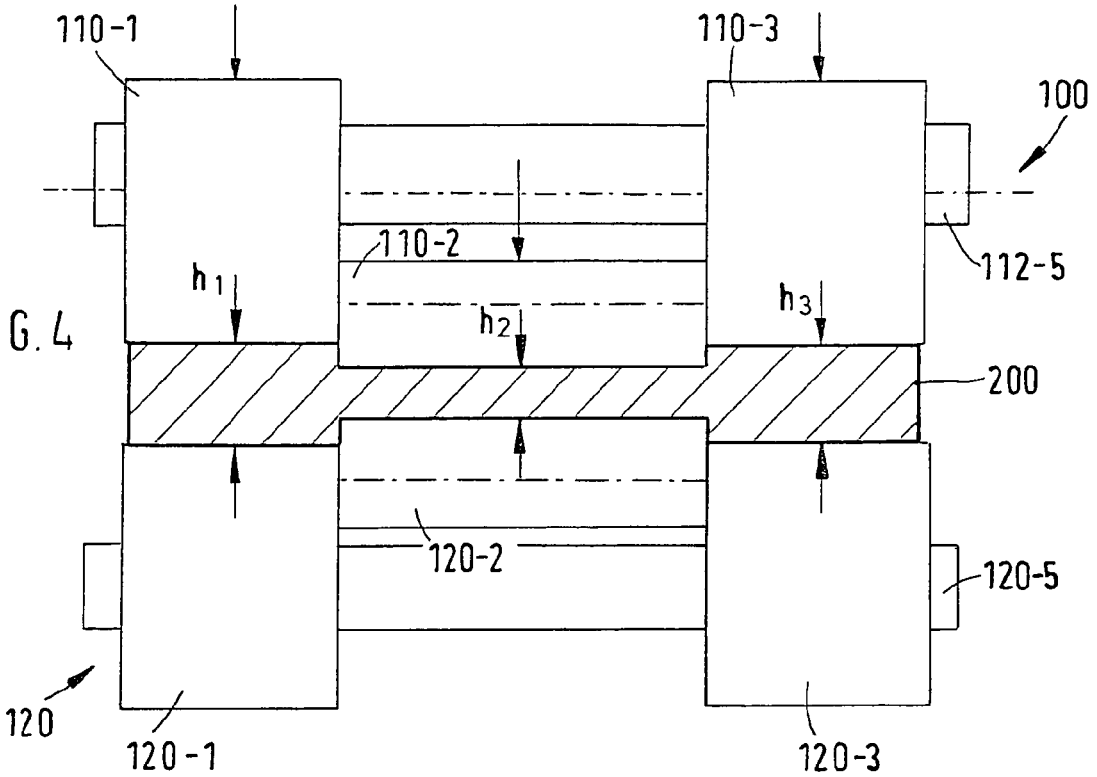

FIG. 4 shows a second embodiment of the rolling stand of the invention.

Figure 5:
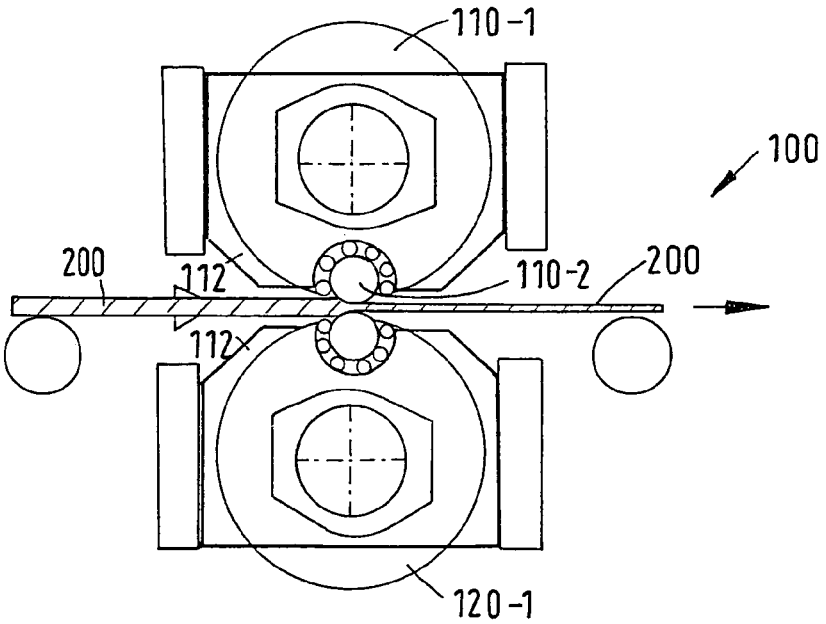

FIG. 5 shows a cross section of the rolling stand of the invention in accordance with the second embodiment.

Figure 6:
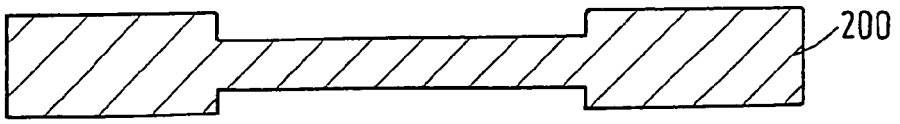

FIG. 6 shows a cross section through the metal strip after the strip has left the rolling stand of the invention in accordance with the second embodiment.

The invention is described in detail below with reference to the specific embodiments illustrated in the aforesaid figures. In all of the figures, parts that are the same are labeled with the same reference numbers.

Figure 1:
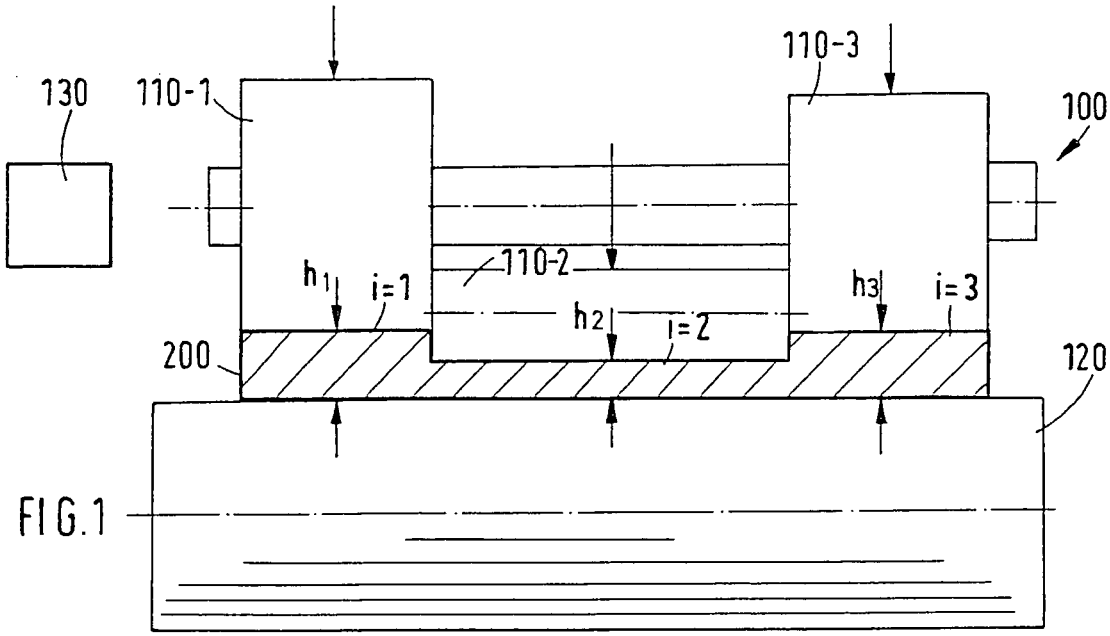
FIG. 1 shows a first embodiment of the rolling stand of the invention.

FIG. 1 shows a first embodiment of the rolling stand 100 in accordance with the invention. Here the rolling stand 100 comprises, by way of example, three partial rolls 100-i, where i=1, 2 , and 3, which are arranged transversely to the direction of conveyance of the metal strip 200 (i.e., the direction perpendicular to the plane of the drawing). The partial rolls are arranged side by side at the same level, i.e., they are not staggered in the direction of conveyance of the metal strip. The three partial rolls 110-i, in cooperation with an opposing support device 120, e.g., in the form of a support roll, each fix an adjacent partial roll gap i=1, i=2, and i=3 with the height values $h_i$, where i=1, 2 , and 3. In this regard, it is important that each two adjacent partial roll gaps i, i+1 have different height values $h_i$, $h_{i+1}$, where $h_i$ is not equal to $h_{i+1}$. The two outer partial rolls 110-1, 110-3 are supported on a common shaft A in FIG. 1 by way of example and therefore are also adjusted, if necessary, in the same way and to the same extent relative to the support device 120. It is advantageous if the individual partial rolls 110-i are adjusted relative to the support device 120 automatically by means of an adjusting device 130, naturally, always taking the claimed mathematical relationship into account:

$$\Delta h_i/h_i=\Delta h_{i+1}/h_{i+1}=\epsilon=\text{constant, with } i=1, 2, \ldots, l \quad (1)$$

where $\Delta h_i$: the thickness reduction of the metal strip by the rolling stand of the invention in the region of the i-th partial roll or step; and $h_i$: the height value of the i-th roll gap or the thickness of the metal strip exiting the rolling stand of the invention in the region of the i-th step.

Figure 2:
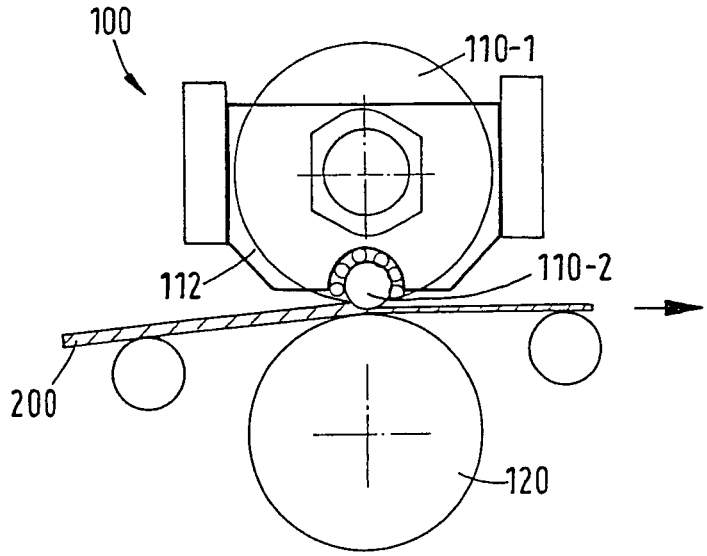
FIG. 2 shows a cross section of the first embodiment of the rolling stand of the invention according to FIG. 1.

FIG. 2 shows a side view of the first embodiment of the rolling stand 100 of the invention from FIG. 1. As was already apparent from FIG. 1, the middle partial roll 110-2 is not supported on the shaft 112-5. Instead, as FIG. 2 shows, it is rotatably supported in a separate roll cage 112. Furthermore, it can also be individually adjusted with respect to the support device 120 by means of the adjusting device 130, independently of the two outer partial rolls 110-1 and 110-3. In FIG. 2, the direction of conveyance of the metal strip is indicated by an arrow that points to the right. In addition, the resulting thickness reduction, especially in the region of the middle partial roll 110-2, is clearly shown.

FIGS. 3*a* and 3*b* show possible profiles of the metal strip 200 after the strip leaves the rolling stand 100 of the invention. Each of these profiles corresponds to the overall roll gap cross section of the rolling stand 100 formed by the adjacent partial roll gaps i=1, 2, 3.

FIG. 4 shows a second embodiment of the rolling stand 100 of the invention. It differs from the first embodiment only in that the support device 120 is no longer designed as a uniform cylinder but rather is constructed with mirror symmetry to the partial rolls on the opposite side of the metal strip. The partial rolls 120-1, 120-2, and 120-3 each have the same barrel length as the mirror-symmetrical partial rolls 110-1, 110-2, and 110-3 they oppose. Preferably, the partial rolls 120-i, where i=1, 2, . . . , 1, can also all be individually adjusted relative to the metal strip 200. By way of example only, the two outer partial rolls 120-1 and 120-3 can be adjusted by a common shaft 120-5 relative to the metal strip 200 and relative to the opposing metal rolls. The partial roll gaps that result from the opposing arrangement of the partial rolls 110-1, 120-1; 110-2, 120-2; 110-3, 120-3 have heights of $h_1$, $h_2$, and $h_3$.

FIG. 5 shows the support of each of the two middle partial rolls 110-2 and 120-2 in a suitable roll cage 112.

Finally, FIG. 6 shows a cross-sectional view of the metal strip 200 leaving the second embodiment of the rolling stand of the invention.

We will now describe the method of the invention for rolling metal strip using the rolling stands described above.

In accordance with this method, the initially typically rectangularly shaped, nonprofiled metal strip is first subjected to stepped preprofiling in a roughing stand. This preprofiling is carried out in geometric approximation to the overall roll cross section of the downstream rolling stand 100 of the invention. In particular, the steps in the metal strip 200 are formed with a step width that corresponds at least approximately to the barrel length of the individual partial rolls 110-1, 110-2, and 110-3 of the downstream rolling stand. Of course, the heights $h_i+\Delta h_i$, where i=1, 2, 3, . . . , of the steps of the metal strips after the preprofiling are still greater than the heights $h_i$, $h_{i+1}$ of the adjacent partial roll gaps i, i+1 in the downstream rolling mill 100. The metal strip that has been subjected to stepped preprofiling in this way then enters the rolling stand 100 in accordance with the invention, in which it is reduced in thickness in the region of each individual partial roll 110-i according to Equation (1). Thickness reduction in accordance with Equation (1) offers the advantage that the metal strip has no waviness in the longitudinal direction after it leaves the rolling stand of the invention.

The use of the formula of the invention will now be illustrated by an example. Let us assume that the metal strip is to pass through a rolling stand of the invention in accordance with FIG. 1 and thus has three steps transverse. to its direction of conveyance. The heights of the individual steps of the metal strip after the strip leaves the roughing stand are preset at $H1=\Delta h_1+h_1=10$ mm for the region of the first outer partial roll 110-1, at $H2=\Delta h_2+h_2=7$ mm for the region of the middle partial roll 110-2, and at $H3=\Delta h_3+h_3=10$ mm for the region of the second outer partial roll 110-3.

For the use of the method of the invention, it is now assumed that the desired thickness $h_1$ of the metal strip 200 for the region of a partial roll 110-i or a step after passage through the rolling stand of the invention is firmly preset. For example, let us assume that the thickness of the metal strip in the region of the first outer partial roll 110-1 after passage through the rolling stand of the invention is to be only 7 mm. Since we know that the step height of the entering metal strip in this region is H1=10 mm, the necessary thickness reduction is obtained by simple subtraction and is found to have the value $\Delta h_i=H1-h_1=10-7=3$ mm.

Knowing $\Delta h_1$ and $h_1$, we can now compute the quantity $\epsilon$ by formula (1):

$$\epsilon=\Delta h_1/h_1=3/7.$$

The thickness reduction $\Delta h_2$ in the adjacent partial roll gap i=2 in the region of the adjacent partial roll 110-2 is now by no means arbitrary but rather is exactly established by the aforesaid formula (1). In concrete terms, the following system of equations comprising Equations (3) and (4) is available for computing the necessary thickness reduction $\Delta h_2$ in this region and for the necessarily resulting step height $h_2$ of the metal strip 200 in this region:

$$H2=\Delta h_2+h_2 \quad (3)$$

and $$\Delta h_2/h_2=\epsilon \quad (4)$$

Solving this system of equations leads to the result:

$$h_2=H2/(\epsilon+1) \quad (5)$$

and $$\Delta h_2=H2-h_2 \quad (6)$$

Substitution of the value H2=7, which was preset for the above example, and the value $\epsilon=3/7$, which was calculated as an intermediate result, into Equation (5) yields the following value for $h_2$:

$$h_2=7/(3/7+1)=4.9 \text{ mm},$$

and substitution of $h_2$ into Equation (6) yields the following value for $\Delta h_2$:

$$\Delta h_2=7-4.9=2.1 \text{ mm}.$$

To ensure that the metal strip 200 leaves the rolling stand 100 of the invention without waviness, it is thus necessary that the thickness of the metal strip in the region of the middle partial roll 110-2 be reduced by 2.1 mm from its preprofiled initial thickness of H2=7 mm to 4.9 mm if the thickness of the metal strip in the region of the first partial roll 110-1 is to be reduced from H1=10 mm to $h_1$=7 mm.

When there is a plurality of partial rolls arranged side by side transversely to the direction of conveyance of the metal strip, this computation of the relative roll gap heights that has just been performed by way of example must then be separately performed for each pair of adjacent partial roll gaps.

The invention can be used especially advantageously in the case of thin metal strips with an initial thickness of less than 10 mm. The method of the invention can be used in both the hot rolling and cold rolling of metal strip. However, the use of this method in accordance with the invention is especially advantageous in hot rolling, because stepped profiling of the metal strip without waviness can then already be realized at a very early stage of production. An example of an area of application is the production of engine base frames for the automobile industry. In the case of cold rolling, it is possible to realize strip geometries that can replace flexible strip rolling in the present well-known form with low production costs. An example of an area of application is again the automobile industry, specifically, the production of undercarriage plates for automobiles.

The invention claimed is:

1. A rolling stand (100) for rolling metal strip (200) having a stepped preprofiling, which comprises at least two independently rotating partial rolls (110-i, where i =1, 2, . . . ,) that are arranged side by side axially in a direction transverse to the direction of conveyance of the metal strip and a support device (120), which is arranged opposite the at least two partial rolls and together with the at least two partial rolls fixes an overall roll gap with an overall roll gap cross section; wherein the two or more adjacent partial rolls (110-i, where i=1,2, . . . ,) are each cylindrically shaped and together with the support device fix respective adjacent partial roll gaps (i, i +1) with different height values $h_i$, $h_{i+1}$, where $h_i \neq h_{i+1}$ and i=1, 2, . . . , where the adjacent partial roll gaps together define the overall roll gap cross section, which has a stepped shape; and where the height values $h_i$ and $h_{i+1}$ of respective adjacent partial roll gaps (i, i+1) are individually selected in such a way that they satisfy the following mathematical relationship:

$$\Delta h_i/h_i=\Delta h_{i+1}/h_{i+1}=\epsilon=\text{constant}$$

with respect to the metal strip (200) entering the overall roll gap, which metal strip (200) has stepped preprofiling that is geometrically similar to the overall roll gap cross section before rolling but which has greater respective step heights of $h_i+\Delta h_i$and $h_{i+1}+\Delta h_{i+1}$, where $h_i+\Delta h_i \neq hi+1+\Delta h_{i+1}$and $\Delta h_1>0$ and $\Delta h_{i+1}>0$, than the partial roll gaps (i).

2. A rolling stand (100) in accordance with claim 1, wherein an adjusting device (130) is included for flexible adjustment of the partial rolls (110-1, 110-2, 110-3) and thus for flexible adjustment of the height values $h_i$ of the partial roll gaps according to the mathematical.

3. A rolling stand (100) in accordance with claim 1, wherein three partial rolls are provided as two outer partial rolls and a middle partial roll (110-1, 110-2, 110-3) arranged over the width of the metal strip, where the two outer partial rolls (110-1, 110-3) are joined with each other by a common shaft (A).

4. A rolling stand (100) in accordance with claim 3, wherein the middle partial roll (110-2) has a smaller diameter than the outer partial sections (110-1, 110-3) and is supported in a roll cage (112) between the two outer partial rolls in such a way that the height $h_2$of the second partial roll gap i=2fixed by the middle partial roll (110-2) with the support device (120) is smaller or larger than the heights $h_1$ and $h_3$ of the two adjacent outer partial roll gaps i=1 and i=3.

5. A rolling stand (100) in accordance with claim 1, wherein the support device (120) is also designed in the form of partial rolls (120-i, where i=1, . . . ,), where these partial rolls (120-i) have the same dimensions as the partial rolls (110-i) on the opposite side of the metal strip and are supported with mirror symmetry to the partial rolls (110-i) with respect to the center plane of the metal strip (200).

6. A rolling train for rolling metal strip, which comprises a plurality of rolling stands arranged one after the other in the running direction of the metal strip, wherein a first rolling stand is provided with shape rolls or grooved rolls for stepped preprofiling of the metal strip; where at least a second rolling stand (100) downstream of the first rolling stand comprises at least two independently rotating partial rolls (110-i, where i=1,2, . . . ,) that are arranged axially side by side in a direction transverse to the direction of conveyance of the metal strip and a support device (120), which is arranged opposite the at least two partial rolls and together with the at least two partial rolls fixes an overall roll gap with an overall roll gap cross section; wherein the two or more adjacent partial rolls (110-i, where i=1,2, . . . ,) are each cylindrically shaped and together with the support device fix respective adjacent partial roll gaps (i,i+1) with different height values $h_i$, $h_{i+1}$, where $h_i \neq h_{i+1}$ and i=1,2, . . . , where the adjacent partial roll gaps together define the overall roll gap cross section, which has a stepped shape; and where the height values $h_i$and $h_{i+1}$ of respective adjacent partial roll gaps (i, i+1) are individually selected in such a way that they satisfy the following mathematical relationship:

$$\Delta h_i/h_i=\Delta h_{i+1}/h_{i+1}=\epsilon=\text{constant}$$

with respect to the metal strip (200) entering the overall roll gap, which metal strip (200) has stepped preprofiling that is geometrically similar to the overall roll gap cross section before rolling but which has greater respective step heights of $h_i+\Delta h_i$ and $h_{i+1}+\Delta h_{i+1}$, where $h_i+\Delta h_i \neq h_{i+1}+\Delta h_{i+1}$ and $\Delta h_i>0$ and $\Delta h_{i+1}>0$, than the partial roll gaps (i); and where the stepped preprofiling of the metal strip by the first rolling stand is carried out in geometric approximation to the stepped cross section of the overall roll gap of the downstream, second rolling stand but with greater step heights of $h_i+\Delta h_i$ and $h_{i+1}$, where $h_i+\Delta h_i \neq h_{i+1}+\Delta h_{i+1}$, in the region of the i-th and (i+1)-th partial roll gap.

7. A method for rolling a metal strip, wherein said method comprises the following steps:

stepped preprofiling of the metal strip in geometric approximation to the stepped cross section of the overall roll gap of a downstream rolling stand (100) but with greater step heights $h_i+\Delta h_i$ and $h_{i+1}+\Delta h_{i+1}$, where $h_i+\Delta h_i \neq h_{i+1}+\Delta h_{i+1}$ and $\Delta h_1>0$ and $\Delta h_{i+1}>0$; and reduction of the individual step heights of the preprofiled metal strip (200) by $\Delta h_i$ to $h_i$, where i=1, . . . , by rolling the preprofiled metal strip in the downstream rolling stand (100), which comprises at least two independently rotating partial rolls (110-i, where i=1, 2, . . . ,) that are arranged axially side by side in a direction transverse to the direction of conveyance of the metal strip and a support device (120), which is arranged opposite the at least two partial rolls and together with the at least two partial rolls fixes an overall roll gap with an overall roll gap cross section; wherein the two or more adjacent partial rolls (110-i, where i=1,2, . . . ,) are each cylindrically shaped and together with the support device fix respective adjacent partial roll gaps (i,i+1) with different height values $h_i$, $h_{i+1}$, where $h_i \neq h_{i+1}$ and i=1,2, . . . , where the adjacent partial roll gaps together define the overall roll gap cross section, which has a stepped shape; and where the height values $h_i$ and $h_{i+1}$ of respective adjacent partial roll gaps (i,i+1) are individually selected in such a way that they satisfy the following mathematical relationship:

$$\Delta h_i/h_i=\Delta h_{i+1}/h_{i+1}=\epsilon=\text{constant}$$

with respect to the metal strip (200) entering the overall roll gap, which metal strip (200) has stepped preprofiling that is geometrically similar to the overall roll gap cross section before rolling but which has greater respective step heights of $h_i+\Delta h_i$ and $h_{i+1}+\Delta h_{i+1}$, where $h_i+\Delta h_i \neq h_{i+1}$ and $\Delta h_1>0$ and $\Delta h_{i+1}>0$, than the partial roll gaps (i).

8. The rolling stand in accordance with claim 1, wherein the at least two partial rolls have a circumferential face and the support device has a circumferential face, the support device being arranged radially opposite the partial rolls so that the circumferential faces of the partial rolls are opposite the circumferential face of the support device.

* * * * *

UNITED STATES PATENT AND TRADEMARK OFFICE

CERTIFICATE OF CORRECTION

PATENT NO. : 8,474,294 B2
APPLICATION NO. : 11/921584
DATED : July 2, 2013
INVENTOR(S) : Reiner Kopp et al.

It is certified that error appears in the above-identified patent and that said Letters Patent is hereby corrected as shown below:

In the Specification

Column 6, line 19, after "mathematical" insert --relationship--.

Signed and Sealed this
Tenth Day of February, 2015

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,474,294 B2
APPLICATION NO. : 11/921584
DATED : July 2, 2013
INVENTOR(S) : Kopp et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 811 days.

Signed and Sealed this
Eighth Day of September, 2015

Michelle K. Lee

Michelle K. Lee
*Director of the United States Patent and Trademark Office*